US010176797B2

(12) United States Patent
Saino et al.

(10) Patent No.: US 10,176,797 B2
(45) Date of Patent: Jan. 8, 2019

(54) VOICE SYNTHESIS METHOD, VOICE SYNTHESIS DEVICE, MEDIUM FOR STORING VOICE SYNTHESIS PROGRAM

(71) Applicant: Yamaha Corporation, Hamamatsu-shi, Shizuoka-Ken (JP)

(72) Inventors: Keijiro Saino, Hamamatsu (JP); Jordi Bonada, Barcelona (ES); Merlijn Blaauw, Barcelona (ES)

(73) Assignee: Yamaha Corporation, Hamamatsu-shi (JP)

( * ) Notice: Subject to any disclaimer, the term of this patent is extended or adjusted under 35 U.S.C. 154(b) by 180 days.

(21) Appl. No.: 15/060,996

(22) Filed: Mar. 4, 2016

(65) Prior Publication Data

US 2016/0260425 A1 Sep. 8, 2016

(30) Foreign Application Priority Data

Mar. 5, 2015 (JP) ..... 2015-043918

(51) Int. Cl.
*G10L 13/00* (2006.01)
*G10L 13/033* (2013.01)
(Continued)

(52) U.S. Cl.
CPC ..... *G10L 13/0335* (2013.01); *G10H 1/0066* (2013.01); *G10L 13/047* (2013.01);
(Continued)

(58) Field of Classification Search
CPC ..... G10L 13/0335; G10L 25/90; G10L 13/06; G10L 13/027; G10L 13/033; G10L 15/18;
(Continued)

(56) References Cited

U.S. PATENT DOCUMENTS 5,806,037 A * 9/1998 Sogo ..... G10H 1/366 704/207
5,902,951 A * 5/1999 Kondo ..... G10H 1/366 434/307 A
(Continued)

FOREIGN PATENT DOCUMENTS

EP 2 270 773 A1 1/2011
JP 2014-98802 A 5/2014

OTHER PUBLICATIONS

European Search Report issued in counterpart European Application No. 16158430.5 dated Apr. 21, 2016 (nine (9) pages).
(Continued)

*Primary Examiner* — Abdelali Serrou
(74) *Attorney, Agent, or Firm* — Crowell & Moring LLP

(57) ABSTRACT

A voice synthesis method for generating a voice signal through connection of a phonetic piece extracted from a reference voice, includes selecting, by a piece selection unit, the phonetic piece sequentially; setting, by a pitch setting unit, a pitch transition in which a fluctuation of an observed pitch of the phonetic piece is reflected based on a degree corresponding to a difference value between a reference pitch being a reference of sound generation of the reference voice and the observed pitch of the phonetic piece selected by the piece selection unit; and generating, by a voice synthesis unit, the voice signal by adjusting a pitch of the phonetic piece selected by the piece selection unit based on the pitch transition generated by the pitch setting unit.

9 Claims, 5 Drawing Sheets

(51) Int. Cl.
*G10L 13/047* (2013.01)
*G10L 13/06* (2013.01)
*G10H 1/00* (2006.01)

(52) U.S. Cl.
CPC ..... *G10L 13/06* (2013.01); *G10H 2210/066* (2013.01); *G10H 2210/331* (2013.01); *G10H 2250/455* (2013.01)

(58) Field of Classification Search
CPC ..... G10L 13/04; G10L 13/07; G10L 15/22; G10L 19/002; G10L 2013/105; G10L 21/0264; G10L 2021/0135; G10L 13/10; G10L 13/02; G10L 25/93; G10L 21/02; G10L 13/00; G10L 13/08; G10L 19/093; G10L 21/00; G10L 21/013; G10L 19/12; G10L 19/18; G10L 19/26; G10L 19/265; G10L 2013/083; G10L 2021/105; G10L 21/003; G10L 21/049; G10L 25/18
See application file for complete search history.

(56) References Cited

U.S. PATENT DOCUMENTS 6,047,253 A * 4/2000 Nishiguchi ..... G10L 19/093 704/207
8,115,089 B2 * 2/2012 Saino ..... G10H 1/0008 704/258
8,338,687 B2 * 12/2012 Saino ..... G10H 1/0008 704/258
2001/0021906 A1 * 9/2001 Chihara ..... G10L 13/10 704/258
2003/0028376 A1 * 2/2003 Meron ..... G10L 13/06 704/258
2003/0221542 A1 * 12/2003 Kenmochi ..... G10H 7/002 84/616
2006/0173676 A1 * 8/2006 Kemmochi ..... G10L 13/06 704/207
2011/0000360 A1 * 1/2011 Saino ..... G10H 1/0008 84/622
2012/0031257 A1 * 2/2012 Saino ..... G10H 1/0058 84/622
2012/0310650 A1 * 12/2012 Bonada ..... G10L 13/06 704/265
2012/0310651 A1 * 12/2012 Saino ..... G10L 13/07 704/267
2013/0311189 A1 * 11/2013 Villavicencio ..... G10L 13/00 704/268
2014/0006018 A1 * 1/2014 Bonada ..... G10L 19/265 704/208
2015/0040743 A1 * 2/2015 Tachibana ..... G10H 1/361 84/622

OTHER PUBLICATIONS

Marti Umbert et al., "Generating Singing Voice Expression Contours Based on Unit Selection", Proc. Stockholm Music Acoustic Conference (SMAC), Jul. 30, 2013, XP055264951, pp. 315-320.
Jordi Bonada et al., "Synthesis of the Singing Voice by Performance Sampling and Spectral Models", IEEE Signal Processing Magazine, Mar. 2007, XP11184118, pp. 67-79.
Suni, A. et al., "Wavelets for intonation modeling in HMM speech synthesis", 8th ISCA Workshop on Speech Synthesis, Proceedings, Barcelona, Aug. 31-Sep. 2, 2013 (Six (6) pages).

* cited by examiner

VOICE SYNTHESIS METHOD, VOICE SYNTHESIS DEVICE, MEDIUM FOR STORING VOICE SYNTHESIS PROGRAM

CROSS-REFERENCE TO RELATED APPLICATION

The present application claims priority from Japanese Application JP 2015-043918, the content of which is hereby incorporated by reference into this application.

BACKGROUND OF THE INVENTION

1. Field of the Invention

One or more embodiments of the present invention relates to a technology for controlling, for example, a temporal fluctuation (hereinafter referred to as "pitch transition") of a pitch of a voice to be synthesized.

2. Description of the Related Art

Hitherto, there has been proposed a voice synthesis technology for synthesizing a singing voice having an arbitrary pitch specified in time series by a user. For example, in Japanese Patent Application Laid-open No. 2014-098802, there is described a configuration for synthesizing a singing voice by setting a pitch transition (pitch curve) corresponding to a time series of a plurality of notes specified as a target to be synthesized, adjusting a pitch of a phonetic piece corresponding to a sound generation detail along the pitch transition, and then concatenating phonetic pieces with each other.

As a technology for generating a pitch transition, there also exist, for example, a configuration using a Fujisaki model, which is disclosed in Fujisaki, "Dynamic Characteristics of Voice Fundamental Frequency in Speech and Singing," In: MacNeilage, P. F. (Ed.), The Production of Speech, Springer-Verlag, New York, USA. pp. 39-55, and a configuration using an HMM generated by machine learning to which a large number of voices are applied, which is disclosed in Keiichi Tokuda, "Basics of Voice Synthesis based on HMM", The Institute of Electronics, Information and Communication Engineers, Technical Research Report, Vol. 100, No. 392, SP2000-74, pp. 43-50, (2000). Further, a configuration for executing machine learning of an HMM by decomposing a pitch transition into five tiers of a sentence, a phrase, a word, a mora, and a phoneme is disclosed in Suni, A. S., Aalto, D., Raitio, T., Alku, P., Vainio, M., et al., "Wavelets for Intonation Modeling in HMM Speech Synthesis," In 8th ISCA Workshop on Speech Synthesis, Proceedings, Barcelona, Aug. 31-Sep. 2, 2013.

SUMMARY OF THE INVENTION

Incidentally, a phenomenon that a pitch conspicuously fluctuates for a short period of time depending on a phoneme of a sound generation target (hereinafter referred to as "phoneme depending fluctuation") is observed in an actual voice uttered by a human. For example, as exemplified in FIG. 9, the phoneme depending fluctuation (so-called micro-prosody) can be confirmed in a section of a voiced consonant (in the example of FIG. 9, sections of a phoneme [m] and a phoneme [g]) and a section in which a transition is made from one of a voiceless consonant and a vowel to another thereof (in the example of FIG. 9, section in which a transition is made from a phoneme [k] to a phoneme [i]).

In the technology of Fujisaki, "Dynamic Characteristics of Voice Fundamental Frequency in Speech and Singing," In: MacNeilage, P. F. (Ed.), The Production of Speech, Springer-Verlag, New York, USA. pp. 39-55, the fluctuation of a pitch over a long period of time such as a sentence is liable to occur, and hence it is difficult to reproduce a phoneme depending fluctuation that occurs in units of phonemes. On the other hand, in the technologies of Keiichi Tokuda, "Basics of Voice Synthesis based on HMM", The Institute of Electronics, Information and Communication Engineers, Technical Research Report, Vol. 100, No. 392, SP2000-74, pp. 43-50, (2000) and Suni, A. S., Aalto, D., Raitio, T., Alku, P., Vainio, M., et al., "Wavelets for Intonation Modeling in HMM Speech Synthesis," In 8th ISCA Workshop on Speech Synthesis, Proceedings, Barcelona, Aug. 31-Sep. 2, 2013, generation of a pitch transition that faithfully reproduces an actual phoneme depending fluctuation is expected when the phoneme depending fluctuation is included in a large number of voices for machine learning. However, a simple error in the pitch other than the phoneme depending fluctuation is also reflected in the pitch transition, which raises a fear that a voice synthesized through use of the pitch transition may be perceived as auditorily out of tune (that is, tone-deaf singing voice deviated from an appropriate pitch). In view of the above-mentioned circumstances, one or more embodiments of the present invention has an object to generate a pitch transition in which a phoneme depending fluctuation is reflected while reducing a fear of being perceived as being out of tune.

In one or more embodiments of the present invention, a voice synthesis method for generating a voice signal through connection of a phonetic piece extracted from a reference voice, includes selecting, by a piece selection unit, the phonetic piece sequentially; setting, by a pitch setting unit, a pitch transition in which a fluctuation of an observed pitch of the phonetic piece is reflected based on a degree corresponding to a difference value between a reference pitch being a reference of sound generation of the reference voice and the observed pitch of the phonetic piece selected by the piece selection unit; and generating, by a voice synthesis unit, the voice signal by adjusting a pitch of the phonetic piece selected by the piece selection unit based on the pitch transition generated by the pitch setting unit.

In one or more embodiments of the present invention, a voice synthesis device configured to generate a voice signal through connection of a phonetic piece extracted from a reference voice, includes a piece selection unit configured to select the phonetic piece sequentially. The voice synthesis device also includes a pitch setting unit configured to set a pitch transition in which a fluctuation of an observed pitch of the phonetic piece is reflected based on a degree corresponding to a difference value between a reference pitch being a reference of sound generation of the reference voice and the observed pitch of the phonetic piece selected by the piece selection unit; and a voice synthesis unit configured to generate the voice signal by adjusting a pitch of the phonetic piece selected by the piece selection unit based on the pitch transition generated by the pitch setting unit.

In one or more embodiments of the present invention, a non-transitory computer-readable recording medium storing a voice synthesis program for generating a voice signal through connection of a phonetic piece extracted from a reference voice, the program causing a computer to function as: a piece selection unit configured to select the phonetic piece sequentially; a pitch setting unit configured to set a pitch transition in which a fluctuation of an observed pitch of the phonetic piece is reflected based on a degree corresponding to a difference value between a reference pitch being a reference of sound generation of the reference voice and the observed pitch of the phonetic piece selected by the piece selection unit; and a voice synthesis unit configured to generate the voice signal by adjusting a pitch of the phonetic piece selected by the piece selection unit based on the pitch transition generated by the pitch setting unit.

DETAILED DESCRIPTION OF THE INVENTION

First Embodiment

Figure 1:
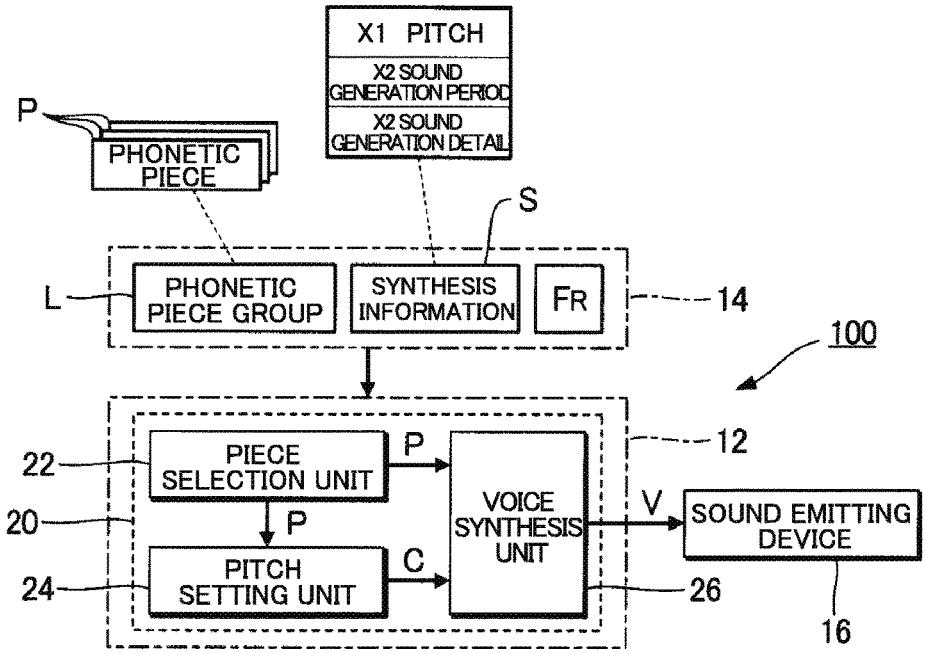
FIG. 1 is a block diagram of a voice synthesis device according to a first embodiment of the present invention.

FIG. 1 is a block diagram of a voice synthesis device 100 according to a first embodiment of the present invention. The voice synthesis device 100 according to the first embodiment is a signal processing device configured to generate a voice signal V of a singing voice of an arbitrary song (hereinafter referred to as "target song"), and is realized by a computer system including a processor 12, a storage device 14, and a sound emitting device 16. For example, a portable information processing device, such as a mobile phone or a smartphone, or a portable or stationary information processing device such as a personal computer may be used as the voice synthesis device 100.

The storage device 14 stores a program executed by the processor 12 and various kinds of data used by the processor 12. A known recording medium such as a semiconductor recording medium or a magnetic recording medium or a combination of a plurality of kinds of recording medium may be arbitrarily employed as the storage device 14. The storage device 14 according to the first embodiment stores a phonetic piece group L and synthesis information S.

The phonetic piece group L is a set (so-called library for voice synthesis) of a plurality of phonetic pieces P extracted in advance from voices (hereinafter referred to as "reference voice") uttered by a specific utterer. Each phonetic piece P is a single phoneme (for example, vowel or consonant), or is a phoneme chain (for example, diphone or triphone) obtained by concatenating a plurality of phonemes. Each phonetic piece P is expressed as a sample sequence of a voice waveform in a time domain or a time series of a spectrum in a frequency domain.

The reference voice is a voice generated with a predetermined pitch (hereinafter referred to as "reference pitch") $F_R$ as a reference. Specifically, an utterer utters the reference voice so that his/her own voice attains the reference pitch $F_R$. Therefore, the pitch of each phonetic piece P basically matches the reference pitch $F_R$, but may contain a fluctuation from the reference pitch $F_R$ ascribable to a phoneme depending fluctuation or the like. As exemplified in FIG. 1, the storage device 14 according to the first embodiment stores the reference pitch $F_R$.

The synthesis information S specifies a voice as a target to be synthesized by the voice synthesis device 100. The synthesis information S according to the first embodiment is time-series data for specifying the time series of a plurality of notes forming a target song, and specifies, as exemplified in FIG. 1, a pitch $X_1$, a sound generation period $X_2$, and a sound generation detail (sound generating character) $X_3$ for each note for the target song. The pitch $X_1$ is specified by, for example, a note number conforming to the musical instrument digital interface (MIDI) standard. The sound generation period $X_2$ is a period to keep generating a sound of the note, and is specified by, for example, a start point of sound generation and a duration (phonetic value) thereof. The sound generation detail $X_3$ is a phonetic unit (specifically, mora of a lyric for the target song) of the synthesized voice.

The processor 12 according to the first embodiment executes a program stored in the storage device 14, to thereby function as a synthesis processing unit 20 configured to generate the voice signal V by using the phonetic piece group L and the synthesis information S that are stored in the storage device 14. Specifically, the synthesis processing unit 20 according to the first embodiment adjusts the respective phonetic pieces P corresponding to the sound generation detail $X_3$ specified in time series by the synthesis information S among the phonetic piece group L based on the pitch $X_1$ and the sound generation period $X_2$, and then connects the respective phonetic pieces P to each other, to thereby generate the voice signal V. Note that, there may be employed a configuration in which functions of the processor 12 are distributed into a plurality of devices or a configuration in which an electronic circuit dedicated to voice synthesis implements a part or all of the functions of the processor 12. The sound emitting device 16 (for example, speaker or headphones) illustrated in FIG. 1 emits acoustics corresponding to the voice signal V generated by the processor 12. Note that, an illustration of a D/A converter configured to convert the voice signal V from a digital signal into an analog signal is omitted for the sake of convenience.

As exemplified in FIG. 1, the synthesis processing unit 20 according to the first embodiment includes a piece selection unit 22, a pitch setting unit 24, and a voice synthesis unit 26. The piece selection unit 22 sequentially selects the respective phonetic pieces P corresponding to the sound generation detail $X_3$ specified in time series by the synthesis information S from the phonetic piece group L within the storage device 14. The pitch setting unit 24 sets a temporal transition (hereinafter referred to as "pitch transition") C of a pitch of a synthesized voice. In brief, the pitch transition (pitch curve) C is set based on the pitch $X_1$ and the sound generation period $X_2$ of the synthesis information S so as to follow the time series of the pitch $X_1$ specified for each note by the synthesis information S. The voice synthesis unit 26 adjusts the pitches of the phonetic pieces P sequentially selected by the piece selection unit 22 based on the pitch transition C generated by the pitch setting unit 24, and concatenates the respective phonetic pieces P that have been adjusted to each other on a time axis, to thereby generate the voice signal V.

Figure 2:
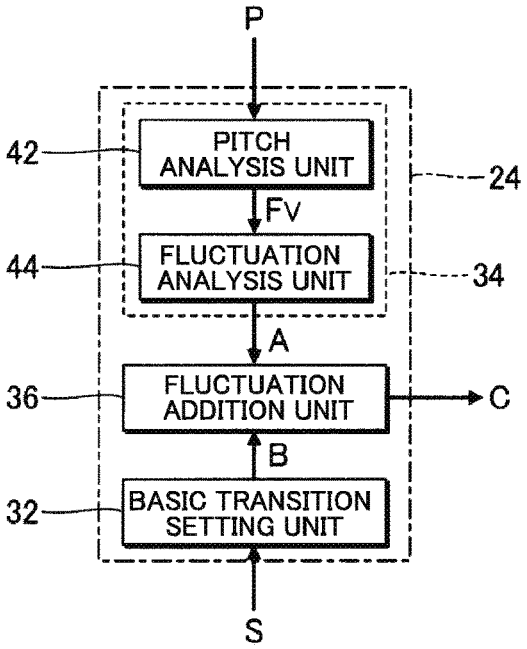
FIG. 2 is a block diagram of a pitch setting unit.

The pitch setting unit 24 according to the first embodiment sets the pitch transition C in which such a phoneme depending fluctuation that the pitch fluctuates for a short period of time depending on a phoneme of a sound generation target is reflected within a range of not being perceived as being out of tune by a listener. FIG. 2 is a specific block diagram of the pitch setting unit 24. As exemplified in FIG. 2, the pitch setting unit 24 according to the first embodiment includes a basic transition setting unit 32, a fluctuation generation unit 34, and a fluctuation addition unit 36.

The basic transition setting unit 32 sets a temporal transition (hereinafter referred to as "basic transition") B of a pitch corresponding to the pitch $X_1$ specified for each note by the synthesis information S. Any known technology may be employed for setting the basic transition B. Specifically, the basic transition B is set so that the pitch continuously fluctuates between notes adjacent to each other on the time axis. In other words, the basic transition B corresponds to a rough locus of the pitch over a plurality of notes that form a melody of the target song. The fluctuation (for example, phoneme depending fluctuation) of the pitch observed in the reference voice is not reflected in the basic transition B.

The fluctuation generation unit 34 generates a fluctuation component A indicating the phoneme depending fluctuation. Specifically, the fluctuation generation unit 34 according to the first embodiment generates the fluctuation component A so that the phoneme depending fluctuation contained in the phonetic pieces P sequentially selected by the piece selection unit 22 is reflected therein. On the other hand, among the respective phonetic pieces P, a fluctuation of the pitch (specifically, pitch fluctuation that can be perceived as being out of tune by the listener) other than the phoneme depending fluctuation is not reflected in the fluctuation component A.

The fluctuation addition unit 36 generates the pitch transition C by adding the fluctuation component A generated by the fluctuation generation unit 34 to the basic transition B set by the basic transition setting unit 32. Therefore, the pitch transition C in which the phoneme depending fluctuation of the respective phonetic pieces P is reflected is generated.

Compared to the fluctuation (hereinafter referred to as "error fluctuation") other than the phoneme depending fluctuation, the phoneme depending fluctuation roughly tends to exhibit a large fluctuation amount of the pitch. In consideration of the above-mentioned tendency, in the first embodiment, the pitch fluctuation in a section exhibiting a large pitch difference (difference value D described later) from the reference pitch $F_R$ among the phonetic pieces P is estimated to be the phoneme depending fluctuation and is reflected in the pitch transition C, while the pitch fluctuation in a section exhibiting a small pitch difference from the reference pitch $F_R$ is estimated to be the error fluctuation other than the phoneme depending fluctuation and is not reflected in the pitch transition C.

As exemplified in FIG. 2, the fluctuation generation unit 34 according to the first embodiment includes a pitch analysis unit 42 and a fluctuation analysis unit 44. The pitch analysis unit 42 sequentially identifies a pitch (hereinafter referred to as "observed pitch") $F_V$ of each phonetic piece P selected by the piece selection unit 22. The observed pitch $F_V$ is sequentially identified with a cycle sufficiently shorter than a time length of the phonetic piece P. Any known pitch detection technology may be employed to identify the observed pitch $F_V$.

Figure 3:
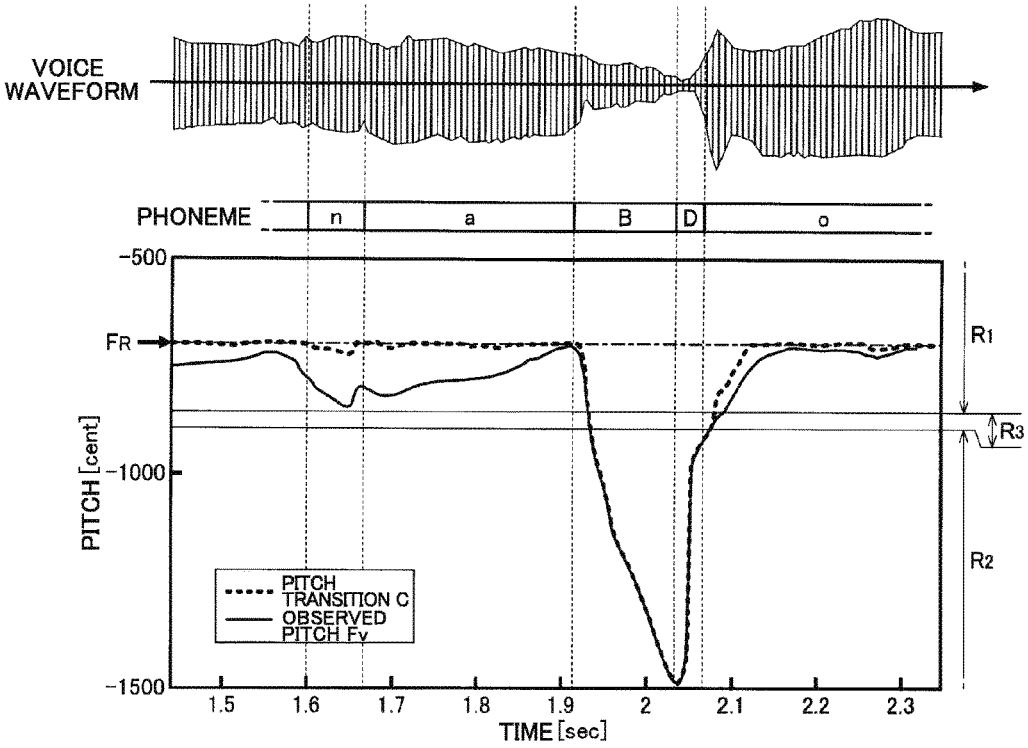
FIG. 3 is a graph for showing an operation of the pitch setting unit.

FIG. 3 is a graph for showing a relationship between the observed pitch $F_V$ and the reference pitch $F_R$ (−700 cents) by assuming a time series ([n], [a], [B], [D], and [o]) of a plurality of the phonemes of the reference voice uttered in Spanish for the sake of convenience. In FIG. 3, a voice waveform of the reference voice is also shown for the sake of convenience. With reference to FIG. 3, such a tendency that the observed pitch $F_V$ falls below the reference pitch $F_R$ with degrees different among the phonemes can be confirmed. Specifically, in sections of phonemes [B] and [D] being voiced consonants, the fluctuation of the observed pitch $F_V$ relative to the reference pitch $F_R$ is observed more conspicuously than in sections of a phoneme [n] being another voiced consonant and phonemes [a] or [o] being vowels. The fluctuation of the observed pitch $F_V$ in the sections of the phonemes [B] and [D] is the phoneme depending fluctuation, while the fluctuation of the observed pitch $F_V$ in the sections of the phonemes [n], [a], and [o] is the error fluctuation other than the phoneme depending fluctuation. In other words, the above-mentioned tendency that the phoneme depending fluctuation exhibits a larger fluctuation amount than the error fluctuation can be confirmed from FIG. 3 as well.

The fluctuation analysis unit 44 illustrated in FIG. 2 generates the fluctuation component A obtained when the phoneme depending fluctuation of the phonetic piece P is estimated. Specifically, the fluctuation analysis unit 44 according to the first embodiment calculates a difference value D between the reference pitch $F_R$ stored in the storage device 14 and the observed pitch $F_V$ identified by the pitch analysis unit 42 ($D=F_R-F_V$), and multiplies the difference value D by an adjustment value $\alpha$, to thereby generate the fluctuation component A ($A=\alpha D=\alpha(F_R-F_V)$). The fluctuation analysis unit 44 according to the first embodiment variably sets the adjustment value $\alpha$ depending on the difference value D in order to reproduce the above-mentioned tendency that the pitch fluctuation in the section exhibiting a large difference value D is estimated to be the phoneme depending fluctuation and is reflected in the pitch transition C, while the pitch fluctuation in the section exhibiting a small difference value D is estimated to be the error fluctuation other than the phoneme depending fluctuation and is not reflected in the pitch transition C. In brief, the fluctuation analysis unit 44 calculates the adjustment value $\alpha$ so that the adjustment value $\alpha$ increases (that is, the pitch fluctuation is reflected in the pitch transition C more dominantly) as the difference value D becomes larger (that is, the pitch fluctuation is more likely to be the phoneme depending fluctuation).

Figure 4:
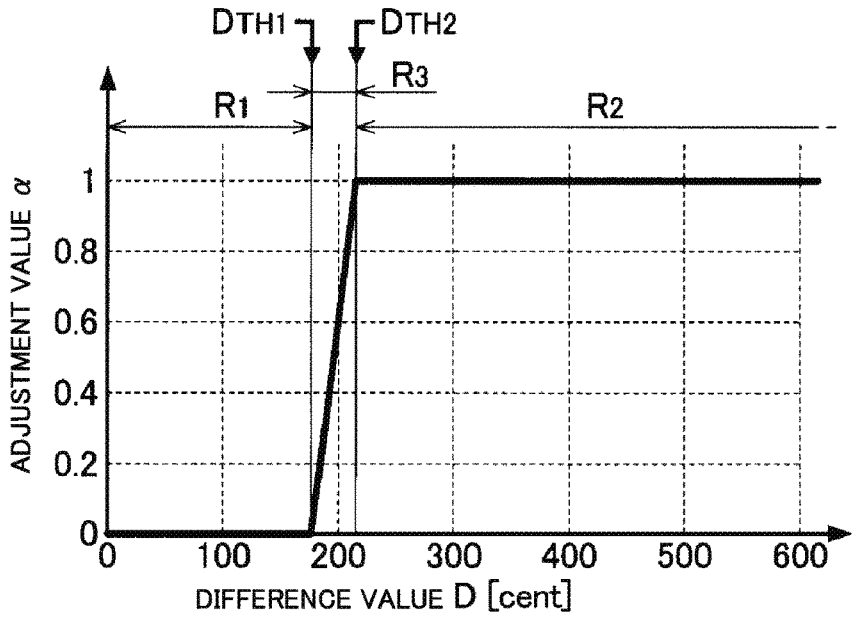
FIG. 4 is a graph for showing a relationship between a difference value between a reference pitch and an observed pitch and an adjustment value.

FIG. 4 is a graph for showing a relationship between the difference value D and the adjustment value $\alpha$. As exemplified in FIG. 4, a numerical value range of the difference value D is segmented into a first range $R_1$, a second range $R_2$, and a third range $R_3$ with a predetermined threshold value $D_{TH1}$ and a predetermined threshold value $D_{TH2}$ set as boundaries. The threshold value $D_{TH2}$ is a predetermined value that exceeds the threshold value $D_{TH1}$. The first range $R_1$ is a range that falls below the threshold value $D_{TH1}$, and the second range $R_2$ is a range that exceeds the threshold value $D_{TH2}$. The third range $R_3$ is a range between the threshold value $D_{TH1}$ and the threshold value $D_{TH2}$. The threshold value $D_{TH}$1 and the threshold value $D_{TH2}$ are selected in advance empirically or statistically so that the difference value D becomes a numerical value within the second range $R_2$ when the fluctuation of the observed pitch $F_V$ is the phoneme depending fluctuation, and the difference value D becomes a numerical value within the first range $R_1$ when the fluctuation of the observed pitch $F_V$ is the error fluctuation other than the phoneme depending fluctuation. In the example of FIG. 4, a case where the threshold value $D_{TH1}$ is set to approximately 170 cents with the threshold value $D_{TH2}$ being set to 220 cents is assumed. When the difference value D is 200 cents (within the third range $R_3$), the adjustment value $\alpha$ is set to 0.6.

As understood from FIG. 4, when the difference value D between the reference pitch $F_R$ and the observed pitch $F_V$ is the numerical value within the first range $R_1$ (that is, when the fluctuation of the observed pitch $F_V$ is estimated to be the error fluctuation), the adjustment value $\alpha$ is set to a minimum value 0. On the other hand, when the difference value D is the numerical value within the second range $R_2$ (that is, when the fluctuation of the observed pitch $F_V$ is estimated to be the phoneme depending fluctuation), the adjustment value $\alpha$ is set to a maximum value 1. Further, when the difference value D is a numerical value within the third range $R_3$, the adjustment value $\alpha$ is set to a numerical value corresponding to the difference value D within a range of 0 or larger and 1 or smaller. Specifically, the adjustment value $\alpha$ is directly proportional to the difference value D within the third range $R_3$.

As described above, the fluctuation analysis unit 44 according to the first embodiment generates the fluctuation component A by multiplying the difference value D by the adjustment value $\alpha$ set under the above-mentioned conditions. Therefore, the adjustment value $\alpha$ is set to the minimum value 0 when the difference value D is the numerical value within the first range $R_1$, to thereby cause the fluctuation component A to be 0, and inhibit the fluctuation of the observed pitch $F_V$ (error fluctuation) from being reflected in the pitch transition C. On the other hand, the adjustment value $\alpha$ is set to the maximum value 1 when the difference value D is the numerical value within the second range $R_2$, and hence the difference value D corresponding to the phoneme depending fluctuation of the observed pitch $F_V$ is generated as the fluctuation component A, with the result that the fluctuation of the observed pitch $F_V$ is reflected in the pitch transition C. As understood from the above description, the maximum value 1 of the adjustment value $\alpha$ means that the fluctuation of the observed pitch $F_V$ is to be reflected in the fluctuation component A (extracted as the phoneme depending fluctuation), while the minimum value 0 of the adjustment value $\alpha$ means that the fluctuation of the observed pitch $F_V$ is not to be reflected in the fluctuation component A (ignored as the error fluctuation). Note that, in regard to the phoneme of a vowel, the difference value D between the observed pitch $F_V$ and the reference pitch $F_R$ falls below the threshold value $D_{TH1}$. Therefore, the fluctuation of the observed pitch $F_V$ of the vowel (fluctuation other than the phoneme depending fluctuation) is not reflected in the pitch transition C.

The fluctuation addition unit 36 illustrated in FIG. 2 generates the pitch transition C by adding the fluctuation component A generated by the fluctuation generation unit 34 (fluctuation analysis unit 44) in accordance with the above-mentioned procedure to the basic transition B. Specifically, the fluctuation addition unit 36 according to the first embodiment subtracts the fluctuation component A from the basic transition B, to thereby generate the pitch transition C (C=B−A). In FIG. 3, the pitch transition C obtained when the basic transition B is assumed to be the reference pitch $F_R$ for the sake of convenience is shown by the broken line together. As understood from FIG. 3, in most part of the sections of the phonemes [n], [a], and [o], the difference value D between the reference pitch $F_R$ and the observed pitch $F_V$ falls below the threshold value $D_{TH1}$, and hence the fluctuation of the observed pitch $F_V$ (namely, error fluctuation) is sufficiently suppressed in the pitch transition C. On the other hand, in most part of the sections of the phonemes [B] and [D], the difference value D exceeds the threshold value $D_{TH2}$, and hence the fluctuation of the observed pitch $F_V$ (namely, phoneme depending fluctuation) is faithfully maintained in the pitch transition C as well. As understood from the above description, the pitch setting unit 24 according to the first embodiment sets the pitch transition C so that a degree to which the fluctuation of the observed pitch $F_V$ of the phonetic piece P is reflected in the pitch transition C becomes larger when the difference value D is the numerical value within the second range $R_2$ than when the difference value D is the numerical value within the first range $R_1$.

Figure 5:
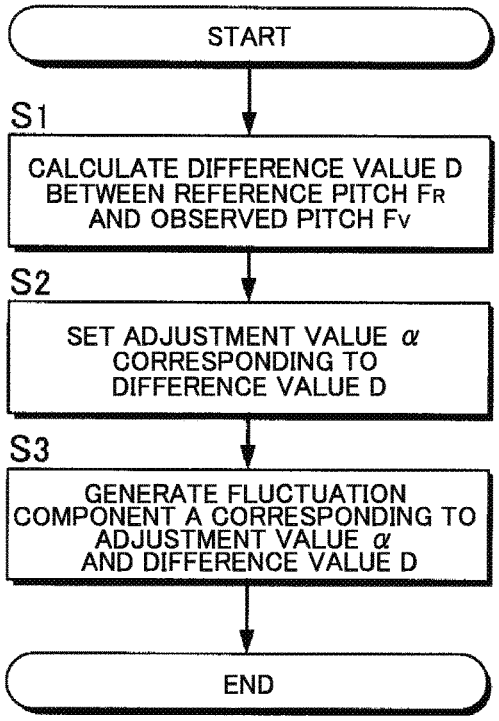
FIG. 5 is a flowchart of an operation of a fluctuation analysis unit.

FIG. 5 is a flowchart of an operation of the fluctuation analysis unit 44. Each time the pitch analysis unit 42 identifies the observed pitch $F_V$ of each of the phonetic pieces P sequentially selected by the piece selection unit 22, processing illustrated in FIG. 5 is executed. When the processing illustrated in FIG. 5 is started, the fluctuation analysis unit 44 calculates the difference value D between the reference pitch $F_R$ stored in the storage device 14 and the observed pitch $F_V$ identified by the pitch analysis unit 42 (S1).

The fluctuation analysis unit 44 sets the adjustment value $\alpha$ corresponding to the difference value D (S2). Specifically, a function (variables such as the threshold value $D_{TH1}$ and the threshold value $D_{TH2}$) for expressing the relationship between the difference value D and the adjustment value $\alpha$, which is described with reference to FIG. 4, is stored in the storage device 14, and the fluctuation analysis unit 44 uses the function stored in the storage device 14 to set the adjustment value $\alpha$ corresponding to the difference value D. Then, the fluctuation analysis unit 44 multiplies the difference value D by the adjustment value $\alpha$, to thereby generate the fluctuation component A (S3).

As described above, in the first embodiment, the pitch transition C in which the fluctuation of the observed pitch $F_V$ is reflected with the degree corresponding to the difference value D between the reference pitch $F_R$ and the observed pitch $F_V$ is set, and hence the pitch transition that faithfully reproduces the phoneme depending fluctuation of the reference voice can be generated while reducing the fear that the synthesized voice may be perceived as being out of tune. In particular, the first embodiment is advantageous in that the phoneme depending fluctuation can be reproduced while maintaining the melody of the target song because the fluctuation component A is added to the basic transition B corresponding to the pitch $X_1$ specified in time series by the synthesis information S.

Further, the first embodiment realizes a remarkable effect that the fluctuation component A can be generated by such simple processing as multiplying the difference value D to be applied to the setting of the adjustment value $\alpha$ by the adjustment value $\alpha$. In particular, in the first embodiment, the adjustment value $\alpha$ is set so as to become the minimum value 0 when the difference value D falls within the first range $R_1$, become the maximum value 1 when the difference value D falls within the second range $R_2$, and become the numerical value that fluctuates depending on the difference value D when the difference value D falls within the third range $R_3$ between both, and hence the above-mentioned effect that generation processing for the fluctuation component A becomes simpler than a configuration in which, for example, various functions including an exponential function are applied to the setting of the adjustment value $\alpha$ is remarkably conspicuous.

Second Embodiment

A second embodiment of the present invention is described. Note that, in each of embodiments exemplified below, components having the same actions or functions as those of the first embodiment are also denoted by the reference symbols used for the description of the first embodiment, and detailed descriptions of the respective components are omitted appropriately.

Figure 6:
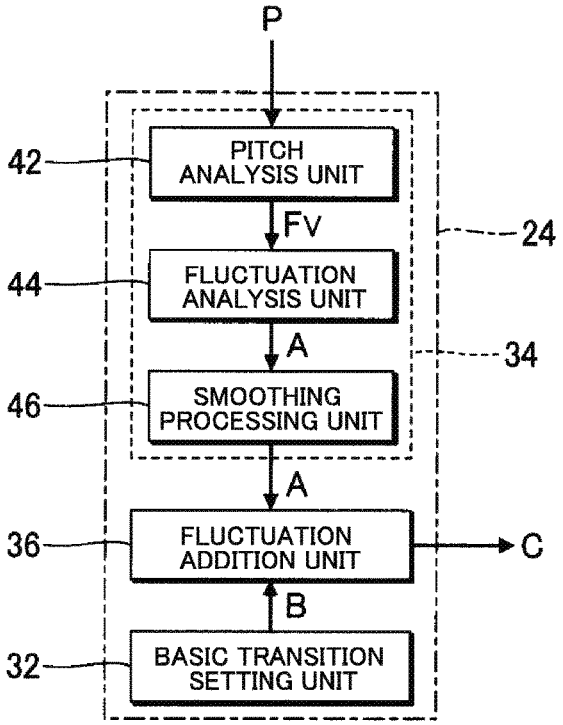
FIG. 6 is a block diagram of a pitch setting unit according to a second embodiment of the present invention.

FIG. 6 is a block diagram of the pitch setting unit 24 according to the second embodiment. As exemplified in FIG. 6, the pitch setting unit 24 according to the second embodiment is configured by adding a smoothing processing unit 46 to the fluctuation generation unit 34 according to the first embodiment. The smoothing processing unit 46 smoothes the fluctuation component A generated by the fluctuation analysis unit 44 on the time axis. Any known technology may be employed to smooth (suppress a temporal fluctuation) the fluctuation component A. On the other hand, the fluctuation addition unit 36 generates the pitch transition C by adding the fluctuation component A that has been smoothed by the smoothing processing unit 46 to the basic transition B.

Figure 7:
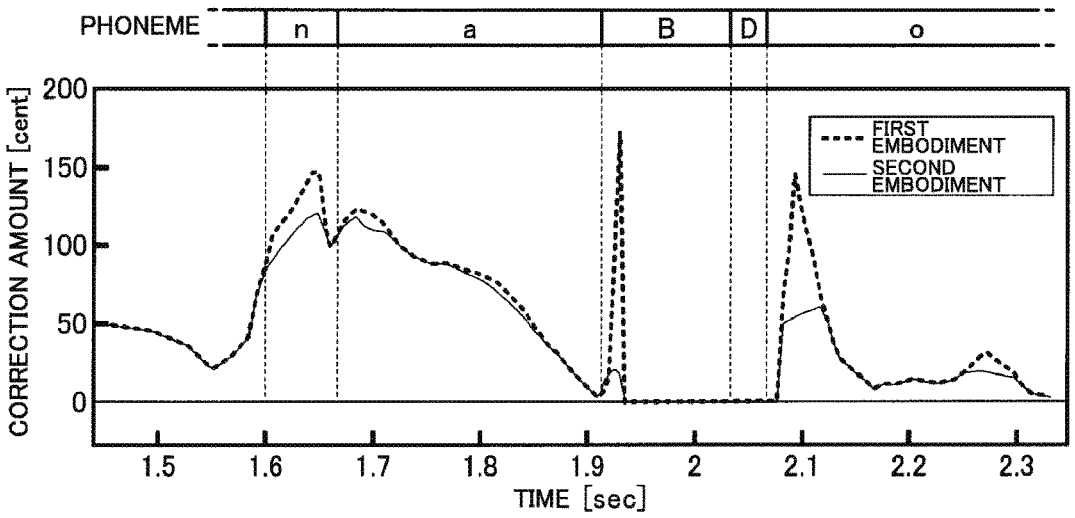
FIG. 7 is a graph for showing an operation of a smoothing processing unit.

In FIG. 7, the time series of the same phonemes as those illustrated in FIG. 3 is assumed, and a time variation of a degree (correction amount) to which the observed pitch $F_V$ of each phonetic piece P is corrected by the fluctuation component A according to the first embodiment is shown by the broken line. In other words, the correction amount indicated by the vertical axis of FIG. 7 corresponds to a difference value between the observed pitch $F_V$ of the reference voice and the pitch transition C obtained when the basic transition B is maintained at the reference pitch $F_R$. Therefore, as grasped in comparison between FIG. 3 and FIG. 7, the correction amount increases in the sections of the phonemes [n], [a], and [o] estimated to exhibit the error fluctuation, while the correction amount is suppressed to near 0 in the sections of the phonemes [B] and [D] estimated to exhibit the phoneme depending fluctuation.

As exemplified in FIG. 7, in the configuration of the first embodiment, the correction amount may steeply fluctuate immediately after a start point of each phoneme, which raises a fear that the synthesized voice that reproduces the voice signal V may be perceived as giving an auditorily unnatural impression. On the other hand, the solid line of FIG. 7 corresponds to a time variation of the correction amount according to the second embodiment. As understood from FIG. 7, in the second embodiment, the fluctuation component A is smoothed by the smoothing processing unit 46, and hence an abrupt fluctuation of the pitch transition C is suppressed more greatly than in the first embodiment. This produces an advantage that the fear that the synthesized voice may be perceived as giving an auditorily unnatural impression is reduced.

Third Embodiment

Figure 8:
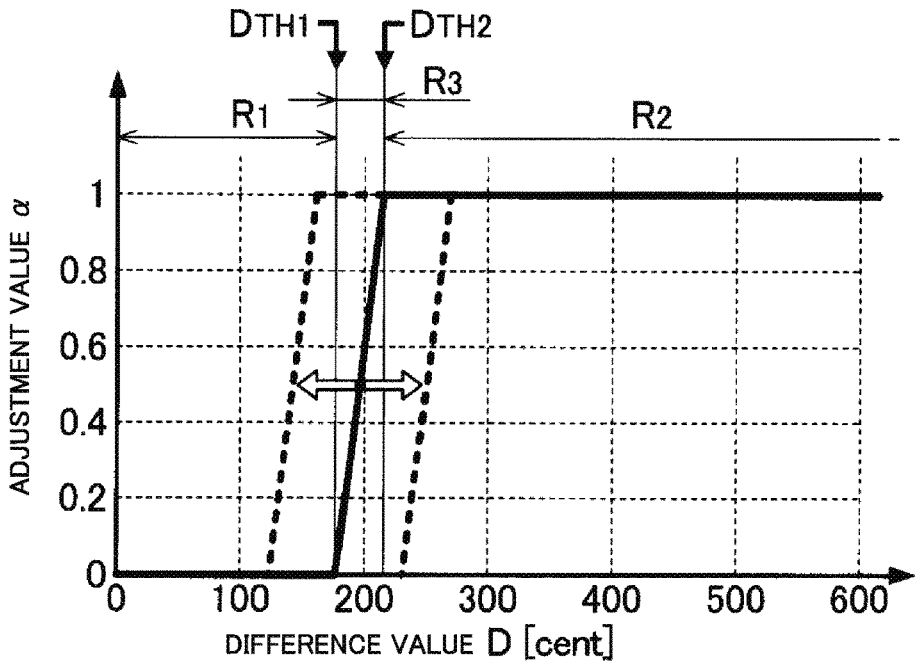
FIG. 8 is a graph for showing a relationship between a difference value and an adjustment value according to a third embodiment of the present invention.
Figure 9:
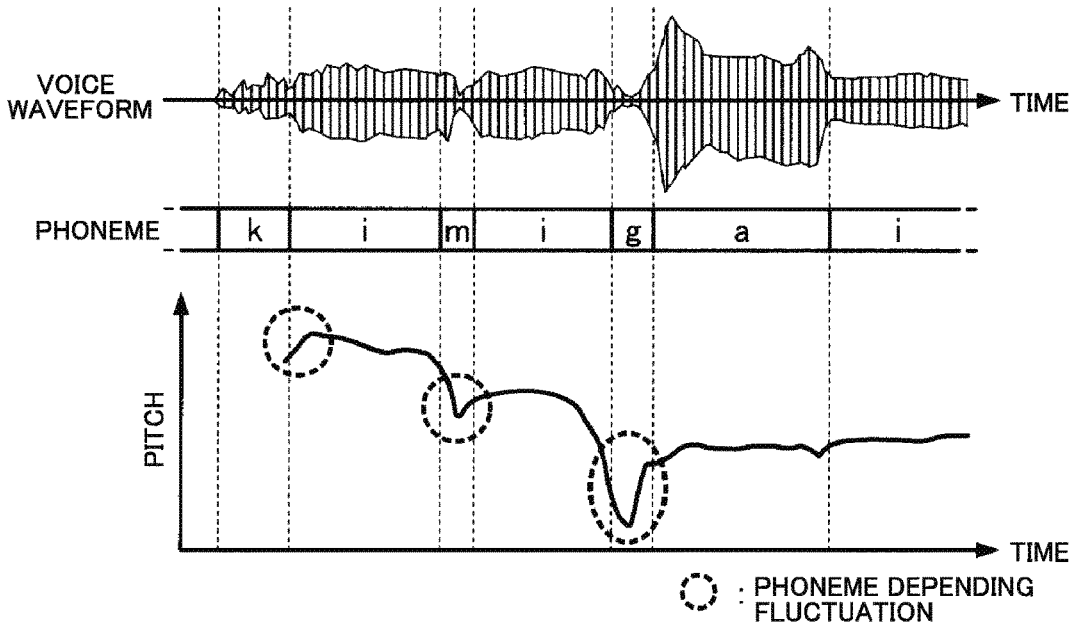
FIG. 9 is a graph for showing a phoneme depending fluctuation.

FIG. 8 is a graph for showing a relationship between the difference value D and the adjustment value α according to a third embodiment of the present invention. As exemplified by the arrows in FIG. 8, the fluctuation analysis unit 44 according to the third embodiment variably sets the threshold value $D_{TH1}$ and the threshold value $D_{TH2}$ that determine the range of the difference value D. As understood from the description of the first embodiment, the adjustment value α is likely to be set to a larger numerical value (for example, maximum value 1) as the threshold value $D_{TH1}$ and the threshold value $D_{TH2}$ become smaller, and hence the fluctuation (phoneme depending fluctuation) of the observed pitch $F_V$ of the phonetic piece P becomes more likely to be reflected in the pitch transition C. On the other hand, the adjustment value α is likely to be set to a smaller numerical value (for example, minimum value 0) as the threshold value $D_{TH1}$ and the threshold value $D_{TH2}$ become larger, and hence the observed pitch $F_V$ of the phonetic piece P becomes less likely to be reflected in the pitch transition C.

Incidentally, the degree of being perceived as being auditorily out of tune (tone-deaf) differs depending on a type of the phoneme. For example, there is a tendency that the voiced consonant such as the phoneme [n] is perceived as being out of tune only when the pitch slightly differs from an original pitch $X_1$ of the target song, while voiced fricatives such as phonemes [v], [z], and [j] is hardly perceived as being out of tune even when the pitch differs from the original pitch $X_1$.

In consideration of a difference in auditory perception characteristics depending on the type of the phoneme, the fluctuation analysis unit 44 according to the third embodiment variably sets the relationship (specifically, threshold value $D_{TH1}$ and threshold value $D_{TH2}$) between the difference value D and the adjustment value α depending on the type of each phoneme of the phonetic pieces P sequentially selected by the piece selection unit 22. Specifically, in regard to the phoneme (for example, [n]) of the type that tends to be perceived as being out of tune, the degree to which the fluctuation of the observed pitch $F_V$ (error fluctuation) is reflected in the pitch transition C is decreased by setting the threshold value $D_{TH1}$ and the threshold value $D_{TH2}$ to a large numerical value. Meanwhile, in regard to the phoneme (for example, [v], [z], or [j]) of the type that tends to be hardly perceived as being out of tune, the degree to which the fluctuation of the observed pitch $F_V$ (phoneme depending fluctuation) is reflected in the pitch transition C is increased by setting the threshold value $D_{TH1}$ and the threshold value $D_{TH2}$ to a small numerical value. The type of each of phonemes that form the phonetic piece P can be identified by the fluctuation analysis unit 44 with reference to, for example, attribute information (information for specifying the type of each phoneme) to be added to each phonetic piece P of the phonetic piece group L.

Also in the third embodiment, the same effects are realized as in the first embodiment. Further, in the third embodiment, the relationship between the difference value D and the adjustment value α is variably controlled, which produces an advantage that the degree to which the fluctuation of the observed pitch $F_V$ of each phonetic piece P is reflected in the pitch transition C can be appropriately adjusted. Further, in the third embodiment, the relationship between the difference value D and the adjustment value α is controlled depending on the type of each phoneme of the phonetic piece P, and hence the above-mentioned effect that the phoneme depending fluctuation of the reference voice can be faithfully reproduced while reducing the fear that the synthesized voice may be perceived as being out of tune is remarkably conspicuous. Note that, the configuration of the second embodiment may be applied to the third embodiment.

Modification Examples

Each of the embodiments exemplified above may be modified variously. Embodiments of specific modifications are exemplified below. It is also possible to appropriately combine at least two embodiments selected arbitrarily from the following examples. (1) In each of the above-mentioned embodiments, the configuration in which the pitch analysis unit 42 identifies the observed pitch $F_V$ of each phonetic piece P is exemplified, but the observed pitch $F_V$ may be stored in advance in the storage device 14 for each phonetic piece P. In the configuration in which the observed pitch $F_V$ is stored in the storage device 14, the pitch analysis unit 42 exemplified in each of the above-mentioned embodiments may be omitted. (2) In each of the above-mentioned embodiments, the configuration in which the adjustment value α fluctuates in a straight line depending on the difference value D is exemplified, but the relationship between the difference value D and the adjustment value α is arbitrarily set. For example, a configuration in which the adjustment value α fluctuates in a curved line relative to the difference value D may be employed. The maximum value and the minimum value of the adjustment value α may be arbitrarily changed. Further, in the third embodiment, the relationship between the difference value D and the adjustment value α is controlled depending on the type of the phoneme of the phonetic piece P, but the fluctuation analysis unit 44 may change the relationship between the difference value D and the adjustment value α based on, for example, an instruction issued by a user. (3) The voice synthesis device 100 may also be realized by a server device for communicating to/from a terminal device through a communication network such as a mobile communication network or the Internet. Specifically, the voice synthesis device 100 generates the voice signal V of the synthesized voice specified by the voice synthesis information S received from the terminal device through the communication network in the same manner as the first embodiment, and transmit the voice signal V to the terminal device through the communication network. Further, for example, a configuration in which the phonetic piece group L is stored in a server device provided separately from the voice synthesis device 100, and the voice synthesis device 100 acquires each phonetic piece P corresponding to the sound generation detail $X_3$ within the synthesis information S from the server device may be employed. In other words, the configuration in which the voice synthesis device 100 holds the phonetic piece group L is not essential.

Note that, a voice synthesis device according to a preferred mode of the present invention is a voice synthesis device configured to generate a voice signal through connection of a phonetic piece extracted from a reference voice, the voice synthesis device including: a piece selection unit configured to sequentially select the phonetic piece; a pitch setting unit configured to set a pitch transition in which a fluctuation of an observed pitch of the phonetic piece is reflected based on a degree corresponding to a difference value between a reference pitch being a reference of sound generation of the reference voice and the observed pitch of the phonetic piece selected by the piece selection unit; and a voice synthesis unit configured to generate the voice signal by adjusting a pitch of the phonetic piece selected by the piece selection unit based on the pitch transition generated by the pitch setting unit. In the above-mentioned configuration, the pitch transition in which the fluctuation of the observed pitch of the phonetic piece is reflected with the degree corresponding to the difference value between the reference pitch being the reference of the sound generation of the reference voice and the observed pitch of the phonetic piece is set. For example, the pitch setting unit sets the pitch transition so that, in comparison with a case where the difference value is a specific numerical value, a degree to which the fluctuation of the observed pitch of the phonetic piece is reflected in the pitch transition becomes larger when the difference value exceeds the specific numerical value. This produces an advantage that the pitch transition that reproduces the phoneme depending fluctuation can be generated while reducing a fear of being perceived as being auditorily out of tune (that is, tone-deaf).

In a preferred mode of the present invention, the pitch setting unit includes: a basic transition setting unit configured to set a basic transition corresponding to a time series of a pitch of a target to be synthesized; a fluctuation generation unit configured to generate a fluctuation component by multiplying the difference value between the reference pitch and the observed pitch by an adjustment value corresponding to the difference value between the reference pitch and the observed pitch; and a fluctuation addition unit configured to add the fluctuation component to the basic transition. In the above-mentioned mode, the fluctuation component obtained by multiplying the difference value by the adjustment value corresponding to the difference value between the reference pitch and the observed pitch is added to the basic transition corresponding to the time series of the pitch of the target to be synthesized, which produces an advantage that the phoneme depending fluctuation can be reproduced while maintaining a transition (for example, melody of a song) of the pitch of the target to be synthesized.

In a preferred mode of the present invention, the fluctuation generation unit sets the adjustment value so as to become a minimum value when the difference value is a numerical value within a first range that falls below a first threshold value, become a maximum value when the difference value is a numerical value within a second range that exceeds a second threshold value larger than the first threshold value, and become a numerical value that fluctuates depending on the difference value within a range between the minimum value and the maximum value when the difference value is a numerical value between the first threshold value and the second threshold value. In the above-mentioned mode, a relationship between the difference value and the adjustment value is defined in a simple manner, which produces an advantage that the setting of the adjustment value (that is, generation of the fluctuation component) is simplified.

In a preferred mode of the present invention, the fluctuation generation unit includes a smoothing processing unit configured to smooth the fluctuation component, and the fluctuation addition unit adds the fluctuation component that has been smoothed to the basic transition. In the above-mentioned mode, the fluctuation component is smoothed, and hence an abrupt fluctuation of the pitch of the synthesized voice is suppressed. This produces an advantage that the synthesized voice that gives an auditorily natural impression can be generated. The specific example of the above-mentioned mode is described above as the second embodiment, for example.

In a preferred mode of the present invention, the fluctuation generation unit variably controls the relationship between the difference value and the adjustment value. Specifically, the fluctuation generation unit controls the relationship between the difference value and the adjustment value depending on the type of the phoneme of the phonetic piece selected by the piece selection unit. The above-mentioned mode produces an advantage that the degree to which the fluctuation of the observed pitch of the phonetic piece is reflected in the pitch transition can be appropriately adjusted. The specific example of the above-mentioned mode is described above as the third embodiment, for example.

The voice synthesis device according to each of the above-mentioned embodiments is implemented by hardware (electronic circuit) such as a digital signal processor (DSP), and is also implemented in cooperation between a general-purpose processor unit such as a central processing unit (CPU) and a program. The program according to the present invention may be installed on a computer by being provided in a form of being stored in a computer-readable recording medium. The recording medium is, for example, a non-transitory recording medium, whose preferred examples include an optical recording medium (optical disc) such as a CD-ROM, and may contain a known recording medium of an arbitrary format, such as a semiconductor recording medium or a magnetic recording medium. For example, the program according to the present invention may be installed on the computer by being provided in a form of being distributed through a communication network. Further, the present invention may be also defined as an operation method (voice synthesis method) for the voice synthesis device according to each of the above-mentioned embodiments.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A voice synthesis method for generating a voice signal through connection of phonetic pieces extracted from reference voices, comprising:

sequentially selecting each phonetic piece from among a plurality of phonetic pieces;

setting a pitch transition in which a fluctuation of an observed pitch of the selected phonetic piece is reflected by a degree corresponding to a difference value between a reference pitch for synthesis of the reference voice and the observed pitch;

generating the voice signal by adjusting a pitch of the selected phonetic piece based on the set pitch transition; and outputting the generated voice signal via a sound emitting device, and wherein the setting of the pitch transition comprises:

setting a basic transition corresponding to synthesis information for a target song;

generating a fluctuation component by multiplying the difference value by the degree corresponding to the difference value; and adding the fluctuation component to the basic transition to obtain the pitch transition, and wherein the generating of the fluctuation component comprises setting the degree so as to become a minimum value, become a maximum value, or become a numerical value that fluctuates depending on the difference value within a range between the minimum value and the maximum value.

2. The voice synthesis method according to claim 1, wherein the degree becomes larger when the difference value exceeds a specific numerical value, in comparison with the difference value that does not exceed the specific numerical value.

3. The voice synthesis method according to claim 1, wherein the degree is the minimum value when the difference value is a numerical value within a first range that falls below a first threshold value, is the maximum value when the difference value is a numerical value within a second range that exceeds a second threshold value larger than the first threshold value, and is the numerical value when the difference value is a numerical value between the first threshold value and the second threshold value.

4. The voice synthesis method according to claim 1, wherein:

the generating of the fluctuation component comprises smoothing the fluctuation component; and the adding of the fluctuation component comprises adding the fluctuation component that has been smoothed to the basic transition.

5. A voice synthesis device configured to generate a voice signal through connection of phonetic pieces extracted from reference voices, comprising:

a piece selection unit configured to sequentially select each phonetic piece from among a plurality of phonetic pieces;

a pitch setting unit configured to set a pitch transition in which a fluctuation of an observed pitch of the phonetic piece selected by the piece selection unit is reflected by a degree corresponding to a difference value between a reference pitch for synthesis of the reference voice and the observed pitch;

a voice synthesis unit configured to generate the voice signal by adjusting a pitch of the phonetic piece selected by the piece selection unit based on the pitch transition generated by the pitch setting unit; and a sound emitting device configured to output the generated voice signal, and wherein the pitch setting unit comprises:

a basic transition setting unit configured to set a basic transition corresponding to synthesis information for a target song;

a fluctuation generation unit configured to generate a fluctuation component by multiplying the difference value by the degree corresponding to the difference value; and a fluctuation addition unit configured to add the fluctuation component to the basic transition to obtain the pitch transition, and wherein the fluctuation generation unit is further configured to set the degree so as to become a minimum value, become a maximum value, or become a numerical value that fluctuates depending on the difference value within a range between the minimum value and the maximum value.

6. The voice synthesis device according to claim 5, wherein the degree becomes larger when the difference value exceeds a specific numerical value, in comparison with the difference value that does not exceed the specific numerical value.

7. The voice synthesis device according to claim 5, wherein is the minimum value when the difference value is a numerical value within a first range that falls below a first threshold value, is the maximum value when the difference value is a numerical value within a second range that exceeds a second threshold value larger than the first threshold value, and is the numerical value when the difference value is a numerical value between the first threshold value and the second threshold value.

8. The voice synthesis device according to claim 5, wherein:

the fluctuation generation unit comprises a smoothing processing unit configured to smooth the fluctuation component; and the fluctuation addition unit is further configured to add the fluctuation component that has been smoothed to the basic transition.

9. A non-transitory computer-readable recording medium storing a voice synthesis program for generating a voice signal through connection of phonetic pieces extracted from reference voices, the program causing a computer to function as:

a piece selection unit configured to sequentially select each phonetic piece from among a plurality of phonetic pieces;

a pitch setting unit configured to set a pitch transition in which a fluctuation of an observed pitch of the phonetic piece selected by the piece selection unit is reflected by a degree corresponding to a difference value between a reference pitch for synthesis of the reference voice and the observed pitch; and a voice synthesis unit configured to generate the voice signal by adjusting a pitch of the phonetic piece selected by the piece selection unit based on the pitch transition generated by the pitch setting unit voice synthesis method for generating a voice signal through connection of a phonetic pieces extracted from reference voices, comprising:

sequentially selecting, by a piece selection unit, each phonetic piece from among a plurality of phonetic pieces;

setting, by a pitch setting unit, a pitch transition in which a fluctuation of an observed pitch of the phonetic piece selected by the piece selection unit is reflected by a degree corresponding to a difference value between a reference pitch for synthesis of the reference voice and the observed pitch;

generating, by a voice synthesis unit, the voice signal by adjusting a pitch of the phonetic piece selected by the piece selection unit based on the pitch transition generated by the pitch setting unit; and outputting the generated voice signal via a sound emitting device, and wherein the setting of the pitch transition comprises:

setting a basic transition corresponding to synthesis information for a target song;

generating a fluctuation component by multiplying the difference value by the degree corresponding to the difference value; and adding the fluctuation component to the basic transition to obtain the pitch transition, and wherein the generating of the fluctuation component comprises setting the degree so as to become a minimum value, become a maximum value, or become a numerical value that fluctuates depending on the difference value within a range between the minimum value and the maximum value.

* * * * *